US006969273B2

(12) United States Patent
Chen

(10) Patent No.: US 6,969,273 B2
(45) Date of Patent: Nov. 29, 2005

(54) TRANSMISSION CABLE FOR COMPUTER

(76) Inventor: Wilson Chen, 3F, No. 1, Alley 6, Lane 45, Pao-Hsin Rd., Hsin-Tien, Taipei (TW)

( * ) Notice: Subject to any disclaimer, the term of this patent is extended or adjusted under 35 U.S.C. 154(b) by 53 days.

(21) Appl. No.: 10/809,506

(22) Filed: Mar. 26, 2004

(65) Prior Publication Data

US 2005/0215108 A1 Sep. 29, 2005

(51) Int. Cl.[7] ..... H01R 3/00
(52) U.S. Cl. ..... 439/490
(58) Field of Search ..... 439/490, 502; 362/236, 249; 340/656, 687

(56) References Cited

U.S. PATENT DOCUMENTS 3,942,859 A * 3/1976 Korodi ..... 439/490
5,081,627 A * 1/1992 Yu ..... 714/46
5,644,462 A * 7/1997 Boschetto et al. ..... 361/91.5
5,666,453 A * 9/1997 Dannenmann ..... 385/101
6,297,963 B1 * 10/2001 Fogle ..... 361/747
6,361,357 B1 * 3/2002 Stillwell et al. ..... 439/490
6,710,254 B2 * 3/2004 Yueh ..... 174/135

* cited by examiner

*Primary Examiner*—Neil Abrams
(74) *Attorney, Agent, or Firm*—Rosenberg, Klein & Lee

(57) ABSTRACT

A transmission cable for connecting a peripheral apparatus to a computer is disclosed to have a cord-like electroluminescent lamp axially extended in the cable between the electric connectors at the ends of the cable, and a detecting and starting circuit installed in the cable and adapted to detect the connection status of the cable between the computer and the peripheral apparatus and to drive on the cord-like electroluminescent lamp upon normal connection of the cable between the computer and the peripheral apparatus.

1 Claim, 4 Drawing Sheets

TRANSMISSION CABLE FOR COMPUTER

BACKGROUND OF THE INVENTION

1. Field of the Invention

The present invention relates to a transmission cable for computer and more particularly, to such a transmission cable, which has a transparent insulative outer shell and uses a cord-like electroluminescent lamp to indicate normal connection of the cable between the computer and the peripheral apparatus and signal transmission status through the cable.

2. Description of the Related Art

FIG. 1 illustrates a transmission cable for computer according to the prior art. According to this design, the transmission cable 10 comprises a cable 12 and two electric connectors 11, 11' at the ends of the cable 12. The transmission cable 10 can be a USB (universal serial bus) design or IEEE1394 parallel bus design. The electric connectors 11, 11' each have a LED (light emitting diode) mounted on the inside. One electric connector 11 or 11' has a detecting circuit (not shown) provided on the inside. The detecting circuit detects connection and signal transmission status of the transmission cable 10, and controls the operation of the LEDs of the electric connectors 11, 11' subject to detection result. This design of transmission cable is functional, however it is still not satisfactory in use. Because the electric connectors 11, 11' are respectively connected to the computer and the peripheral apparatus, the computer and the peripheral apparatus may keep the light of the LEDs of the electric connectors 11, 11' from sight. Further, when several transmission cables are arranged together, the user cannot quickly inspect the connection status of one specific transmission cable from a group of transmission cables.

SUMMARY OF THE INVENTION

The present invention has been accomplished under the circumstances in view. It is one object of the present invention to provide a transmission cable for computer, which gives off light through the length of the cable to indicate normal connection of the cable between the computer and the peripheral apparatus. It is another object of the present invention to provide a transmission cable for computer, which gives off a particular color of light for quick identification upon normal connection of the cable between the computer and the peripheral apparatus. To achieve these and other objects of the present invention, the transmission cable comprises two electric connectors for connection to the computer and the peripheral apparatus respectively, each electric connector comprising an indicator light, a cable connected between the electric connectors, a cord-like electroluminescent lamp installed in the cable and electrically connected between the electric connector, and a control device installed in the cable and electrically connected to the cord-like electroluminescent lamp and the indicator lights of the electric connectors. The control device comprises a detecting and starting circuit adapted to detect electric connection of the electric connectors between the computer and the peripheral apparatus, and to drive on/off the cord-like electroluminescent lamp and the indicator lights of the electric connectors subject to the connection status of the electric connectors between the computer and the peripheral apparatus.

DETAILED DESCRIPTION OF THE PREFERRED EMBODIMENT

Figure 1:
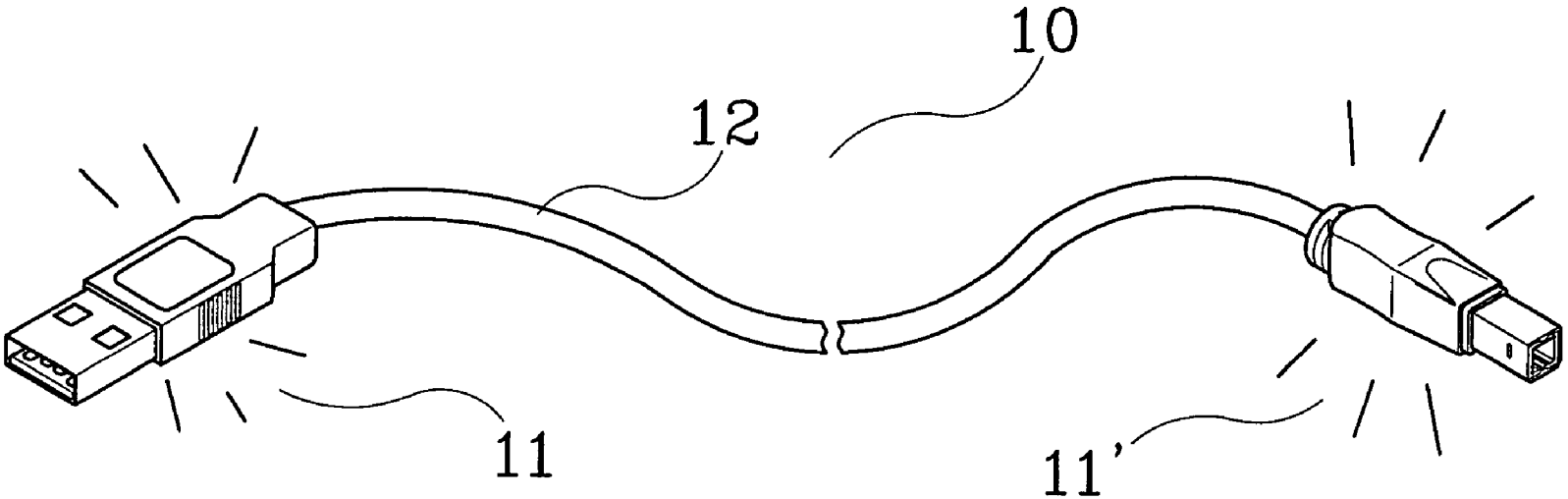
FIG. 1(PRIOR ART)
FIG. 1 is a schematic drawing of a transmission cable for computer according to the prior art.
Figure 2:
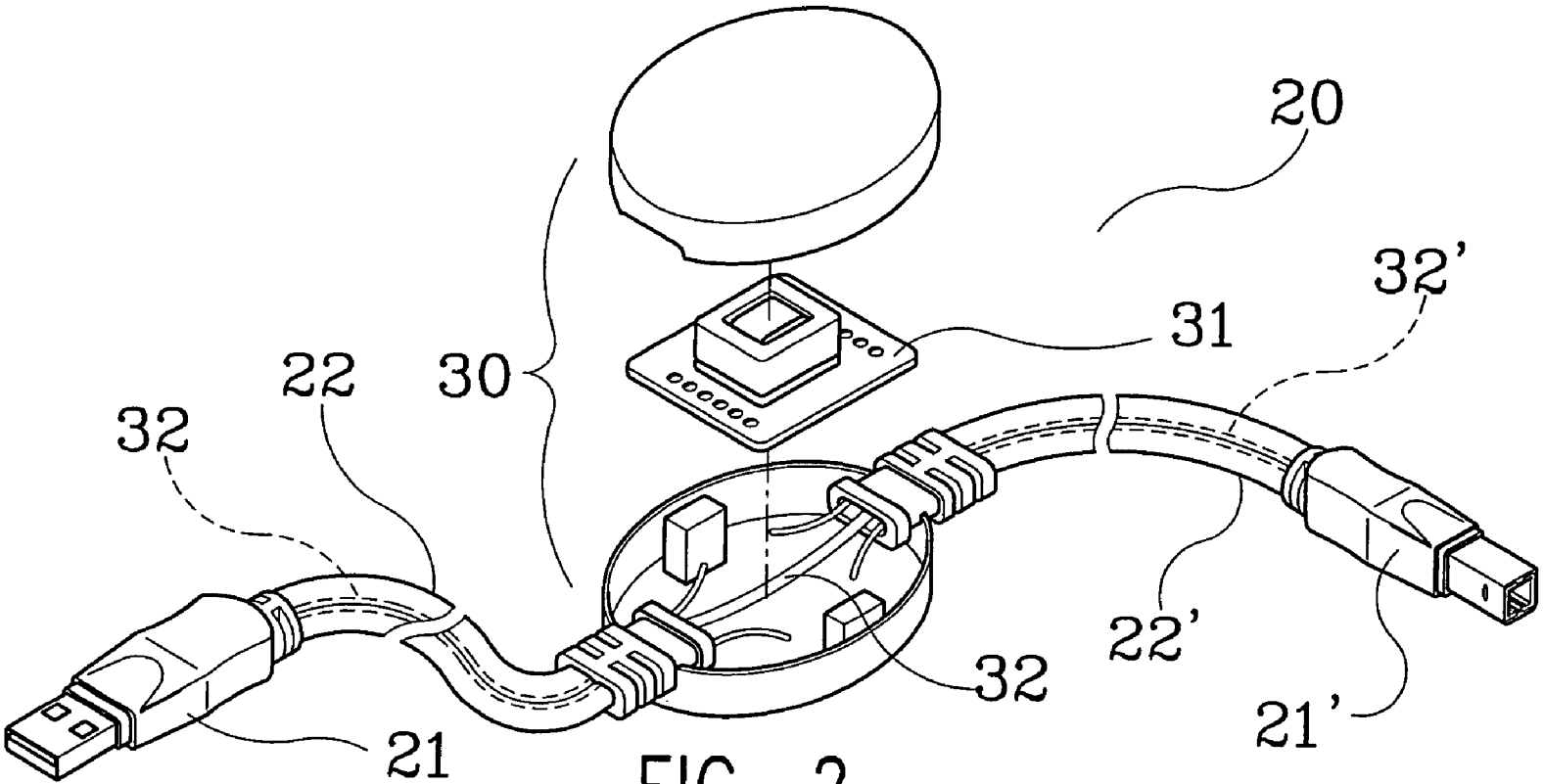
FIG. 2 is an exploded view of a transmission cable for computer according to the present invention.
Figure 3:
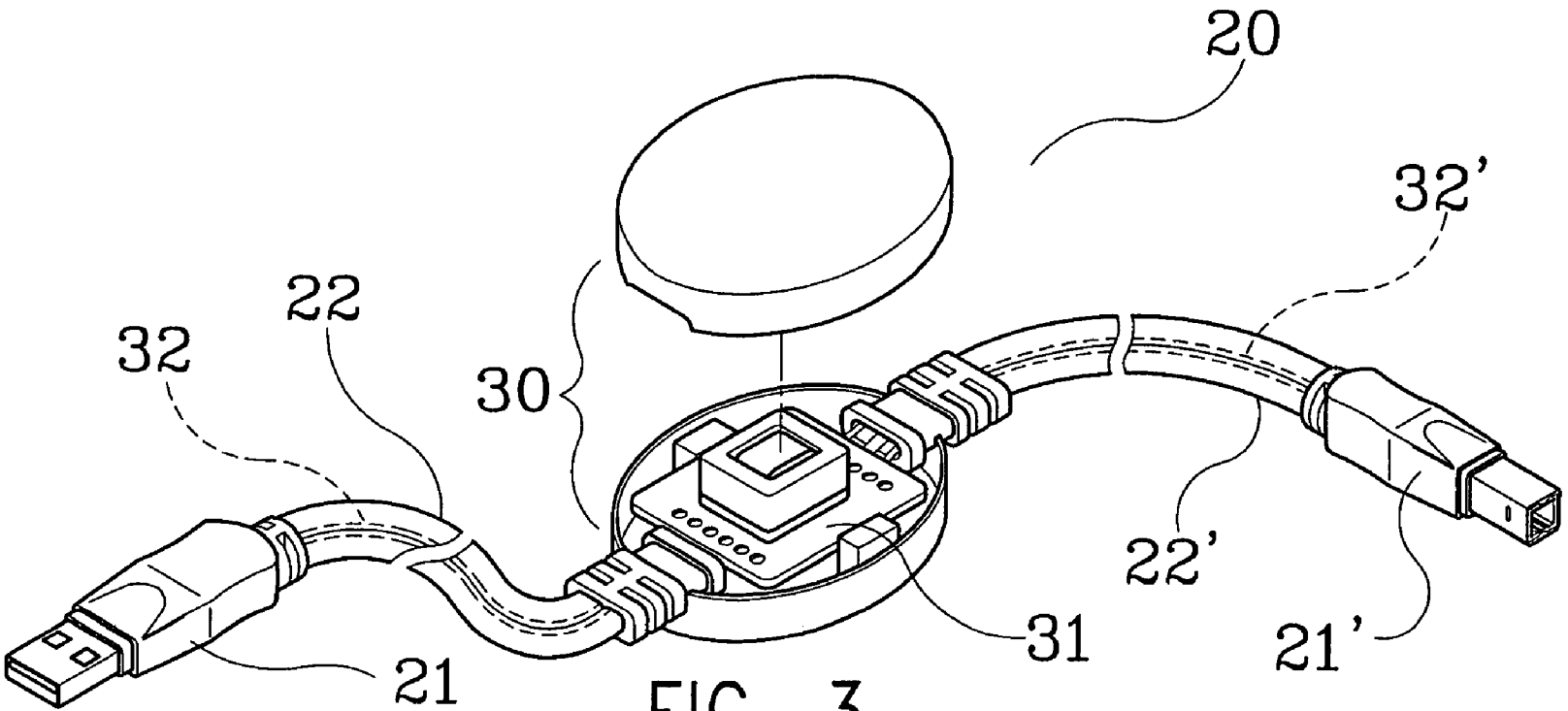
FIG. 3 is a schematic assembly view of FIG. 2.

Referring to FIGS. 2 and 3, a transmission cable 20 is shown for connecting a peripheral apparatus to a computer. The transmission cable 20 can be a universal serial bus or IEEE1394 parallel bus design, comprising a cable 22, 22', two electric connectors 21, 21' respectively connected to the two distal ends of the cable 22, 22', a control device 30 installed in the cable 22, 22', and a cord-like electroluminescent lamp 32, 32' axially mounted in the cable 22, 22' and extended through the control device 30 and electrically connected between the electric connectors 21, 21'. The cable 22, 22' has an electrically insulative transparent outer shell. The electric connectors 21, 21' each are equipped with an indicator light (lighting emitting diode).

The control device 30 comprises a detecting and starting circuit 31 adapted to detect normal connection of the transmission cable between the computer and the peripheral apparatus and to start the cord-like electroluminescent lamp 32, 32' and the LEDs in the electric connectors 21, 21'.

Figure 4:
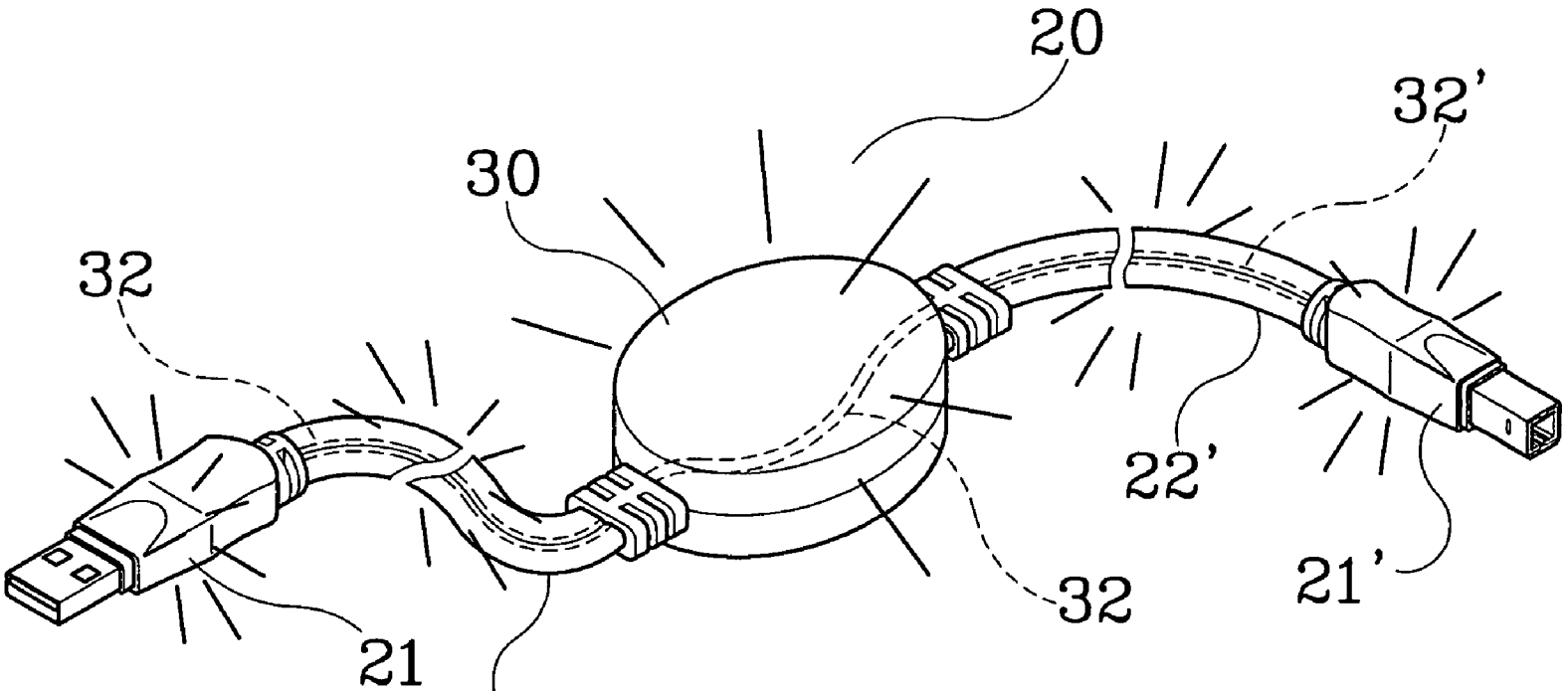
FIG. 4 is a schematic drawing showing a status of use of the transmission cable according to the present invention.

The detecting and starting circuit 31 obtains 5V power supply from the computer, and converts 5V into 140V~180V for the cord-like electroluminescent lamp 32, 32'. The detecting and starting circuit 31 turns on the cord-like electroluminescent lamp 32, 32' and the LEDs in the electric connectors 21, 21' (see FIG. 4) after normal connection of the transmission cable 20 between the computer and the peripheral apparatus, and drives the cord-like electroluminescent lamp 32, 32' and the LEDs in the electric connectors 21, 21' to flash upon transmission of a signal between the computer and the peripheral apparatus. On the contrary, disconnection of the transmission cable 20 between the computer and the peripheral apparatus causes the detecting and starting circuit 31 to turn off the cord-like electroluminescent lamp 32, 32' and the LEDs in the electric connectors 21, 21'.

Further, the cord-like electroluminescent lamp 32, 32' can be made to produce a particular color of light. By means of the control of the detecting and starting circuit 31, the cord-like electroluminescent lamp 32, 32' is automatically turned on to emit cold light upon connection of the transmission cable 20 between the computer and the peripheral apparatus, and driven to flash upon transmission of a signal between the computer and the peripheral apparatus through the transmission cable 20.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A transmission cable for connecting a peripheral apparatus to a computer for signal transmission, the transmission cable comprising two electric connectors for connection to the computer and the peripheral apparatus respectively, and a cable connected between said electric connectors, said electric connectors each comprising an indicator light, wherein a cord-like electroluminescent lamp is installed in said cable and extended between said electric connectors; a control device is installed in said cable and electrically connected to said cord-like electroluminescent lamp and the indicator lights of said electric connectors, said control device comprising a detecting and starting circuit adapted to detect electric connection of said electric connectors between the computer and the peripheral apparatus and to drive on/off said cord-like electroluminescent lamp and the indicator lights of said electric connector subject to the connection status of said electric connectors between the computer and the peripheral apparatus.

* * * * *